US006007391A

United States Patent [19]

Eilert

[11] Patent Number: 6,007,391

[45] Date of Patent: Dec. 28, 1999

[54] AUTOMATICALLY ADJUSTABLE TRIM SYSTEM

[75] Inventor: John R. Eilert, Fond du Lac, Wis.

[73] Assignee: Brunswick Corporation, Lake Forest, Ill.

[21] Appl. No.: 08/998,165

[22] Filed: Dec. 24, 1997

[51] Int. Cl.[6] ..... B63H 5/125

[52] U.S. Cl. ..... 440/53

[58] Field of Search ..... 440/53, 62, 63; 248/640–643

[56] References Cited

U.S. PATENT DOCUMENTS

| | | | |
|---|---|---|---|
| 2,886,462 | 5/1959 | Jagiel | 440/53 |
| 2,966,876 | 1/1961 | MacWilliam | 115/41 |
| 2,997,014 | 8/1961 | Puckett | 440/53 |
| 3,460,505 | 8/1969 | Thoene | 440/53 |
| 4,331,430 | 5/1982 | Lutzke et al. | 440/53 |
| 4,472,148 | 9/1984 | Kollock et al. | 440/53 |
| 4,826,459 | 5/1989 | Slattery | 440/55 |
| 4,925,410 | 5/1990 | Boda | 440/55 |
| 5,522,338 | 6/1996 | Eilert et al. | 114/345 |

*Primary Examiner*—Ed Swinehart
*Attorney, Agent, or Firm*—Andrus, Sceales, Starke & Sawall

[57] ABSTRACT

An automatically adjustable trim system for a marine propulsion system provides automatic trimming of the propeller in response to increased loads on the propeller. A propulsion unit is attached to a boat transom through a tilt mechanism including a transom bracket and a swivel bracket. In a first embodiment, the transom bracket is clamped to a flexible transom which flexes in response to forces exerted on the transom during acceleration. In a second embodiment, the transom bracket is clamped to a transom bracket mounting platform that is generally parallel to and pivotally attached to the transom. A trim angle biasing mechanism is mounted between the transom and the transom bracket mounting platform for automatically adjusting the trim angle. A third embodiment includes a trim angle biasing mechanism incorporated into the transom bracket or swivel bracket. A fourth embodiment includes a spring-loaded pawl assembly between the swivel bracket and transom bracket.

10 Claims, 6 Drawing Sheets

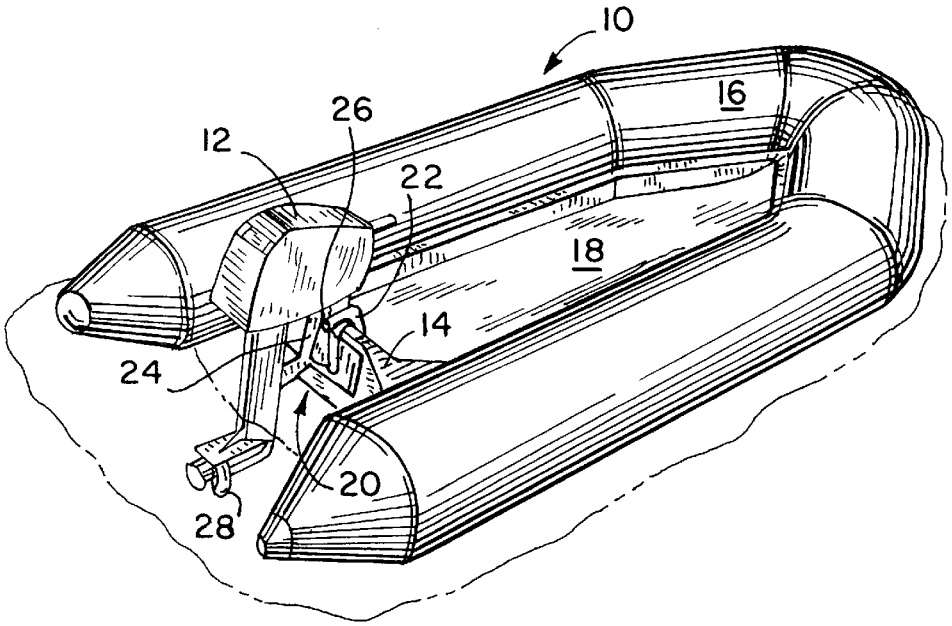
FIG. 1
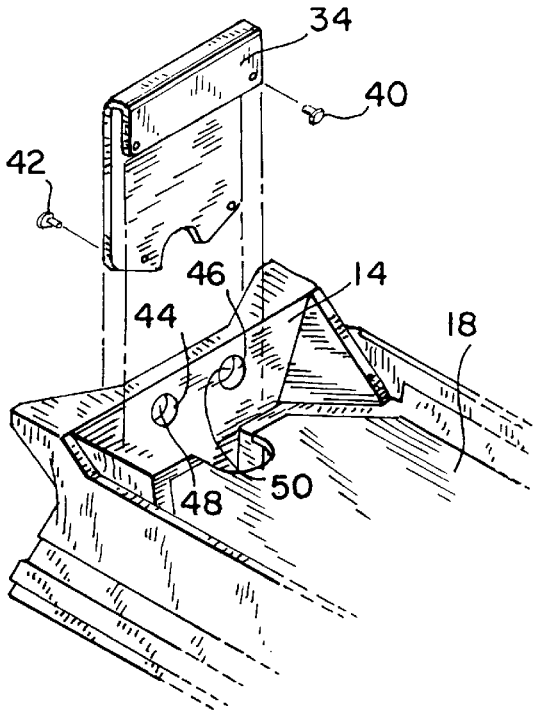
FIG. 3
FIG. 2
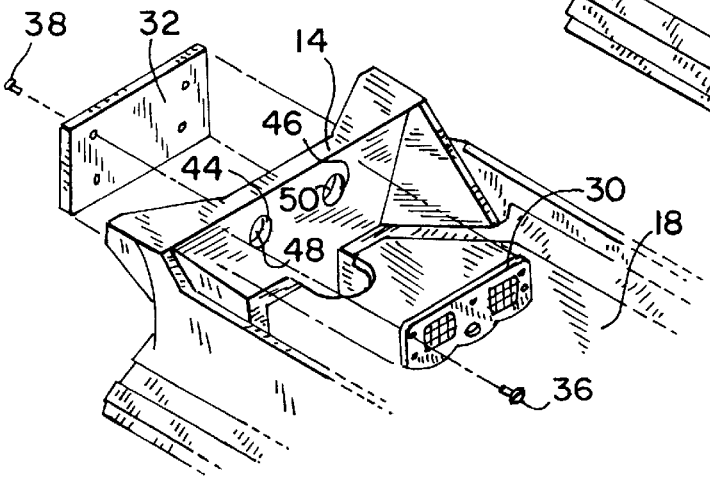

AUTOMATICALLY ADJUSTABLE TRIM SYSTEM

FIELD OF THE INVENTION

The invention relates to trim systems for marine propulsion systems. In particular, the invention provides automatic adjustment of trim angle to improve acceleration and steering control, especially in small boats.

BACKGROUND OF THE INVENTION

In general, when a boat first accelerates from a standstill or a relatively slow speed before the boat gets up on plane, the bow of the boat lifts out of the water. Bow lift (i.e., hull pitch attitude for the boat) can become steep when accelerating smaller, shorter boats rapidly from a standstill or a very slow speed. Boat acceleration and steering control are compromised when the hull pitch attitude becomes excessively steep. Therefore, it is advantageous to keep the bow of a boat relatively low, not only to improve boat acceleration and steering control, but also to improve driver visibility. Bow lift during slow speed acceleration can be reduced by trimming the propeller inwardly towards the transom of the boat.

Normally, marine propulsion systems, e.g., outboard motors and inboard/outboard motors (stern drives), are trimmed to orient the propeller in a position that optimizes performance after the boat gets up on plane. Trimming the marine propulsion system to orient the propeller in a position which reduces bow attitude while accelerating at slow speeds tends to compromise performance when the boat gets up on plane. Therefore, it is desirable to provide a trim system that automatically adjusts the trim angle of the marine propulsion system inwardly towards the boat in response to increased loads on the propeller.

SUMMARY OF THE INVENTION

This invention is an automatically adjustable trim system for marine propulsion systems that automatically adjusts the trim angle of the propulsion system inwardly in response to increased loads on the propeller. The invention thus provides automatic trim adjustment during boat acceleration to lessen the tendency of the bow of the boat to lift up out of the water. The invention is most effective on smaller, shorter boats having engines up to about 50 horsepower. An automatically adjustable trim system in accordance with the invention can be incorporated into the propulsion system tilt mechanism, built into the transom of the boat or installed as an accessory that is mounted to the transom.

In a typical application of the invention, an outboard motor having a propeller is mounted to a boat transom using a tilt mechanism. The tilt mechanism includes a transom bracket and a swivel bracket. The transom bracket is clamped to the transom of the boat, while the swivel bracket is pivotally attached to the transom bracket about a first horizontal axis. The outboard motor is rotatably mounted to the swivel bracket about a vertical axis for steering the boat. The tilt mechanism enables positioning of the outboard motor at a preselected trim angle that is generally appropriate for when the boat gets up on plane.

In one embodiment of the invention, the boat has a flexible transom. The transom is preferably made from polyethylene or another suitable material chosen to have a desired degree of flexure in the structural dimensions of a transom, to in turn provide desired automatic trim angle adjustment. The transom flexes in response to rotational forces exerted on the transom by the transom bracket which are caused by increased loads on the propeller during acceleration. The flexure of the transom automatically allows the propeller to trim inwardly towards the boat to adjust the trim angle in response to increased loads on the propeller. After the boat gets up on plane and the loads on the propeller decrease, the transom returns to its normal position.

In another embodiment, the transom is preferably rigid, and the transom bracket is clamped to a transom bracket mounting platform mounted to the transom. The platform is generally parallel to and pivotally attached to the transom for rotation about a second horizontal axis. A trim angle biasing mechanism is located between the transom and the platform below the second horizontal axis. The trim angle biasing mechanism maintains the position of the outboard motor at a preselected trim angle unless increased loads on the propeller cause the transom bracket to exert forces on the platform rotating the platform inwardly against the biasing force of the trim angle biasing mechanism. The preferred trim angle biasing mechanism includes a connecting rod mounted generally perpendicularly between the transom and the platform. The connecting rod is slidably mounted through the platform and/or the transom to allow the platform to rotate inwardly towards the transom. A compression spring is mounted over the connecting rod between the transom and the platform. The connecting rod preferably includes an adjustable head for adjusting the biasing force of the compression spring. The connecting rod also preferably includes a trim angle limit stop to prevent movement of the platform outwardly beyond a maximum trim angle position. In this embodiment, the transom is preferably rigid, and the platform may be rigid or may be a material such as polyethylene which flexes in response to forces exerted on the platform by the transom bracket which are caused by increased loads on the propeller.

In another embodiment of the invention, the transom bracket is clamped to a rigid transom, and a trim angle biasing mechanism is mounted between the transom bracket and the swivel bracket of the outboard motor. The trim angle biasing mechanism includes a connecting rod that is mounted between the swivel bracket and the transom bracket. A compression spring is mounted over the connecting rod between the swivel bracket and the transom bracket. The connecting rod includes an adjustable head for adjusting the biasing force of the compression spring. The connecting rod also has a trim angle limit stop which prevents movement of the outboard motor outwardly beyond a maximum trim angle position.

In yet another embodiment of the invention, a spring-loaded pawl assembly is provided between the transom bracket and the swivel bracket. One end of the pawl assembly is pivotally attached to the swivel bracket and the other end has a trim pin adapted to engage in one or more trim position notches in the transom bracket for adjusting the trim angle of the outboard motor. The pawl assembly includes a compression spring located within a slotted groove to engage the trim pin. The compression spring exerts a force against the trim pin, holding it in place within the desired trim position notch in the transom bracket. The spring-loaded pawl assembly automatically adjusts the trim position of the outboard motor in response to increased loads on the propeller.

The automatically adjustable trim system may also be incorporated into an inboard/outboard (stern drive) marine propulsion system having an engine located within a boat and an outdrive powered by the engine and mounted to the boat's transom. In this case, the automatically adjustable trim system includes means for positioning the outdrive at a preselected trim angle and means for automatically trimming the outdrive inwardly towards the boat to adjust the trim angle in response to increased loads on the propeller. These means include the various trim angle biasing mechanisms described above for an outboard motor. The trim system mounted to the outdrive automatically adjusts the trim angle in response to increased loads on the propeller.

Various other aspects, features and advantages of the invention will be made apparent from the following drawings and detailed description.

BRIEF DESCRIPTION OF THE DRAWINGS

FIG. 1 is a perspective view showing a boat having an outboard motor attached to a transom in accordance with the present invention.

FIG. 2 is an exploded view of the transom of FIG. 1 showing a transom plate and a transom pad attached to the transom.

FIG. 3 is an exploded view similar to FIG. 2 showing a transom stiffener attached to the transom.

DETAILED DESCRIPTION OF THE INVENTION

Figure 4A:
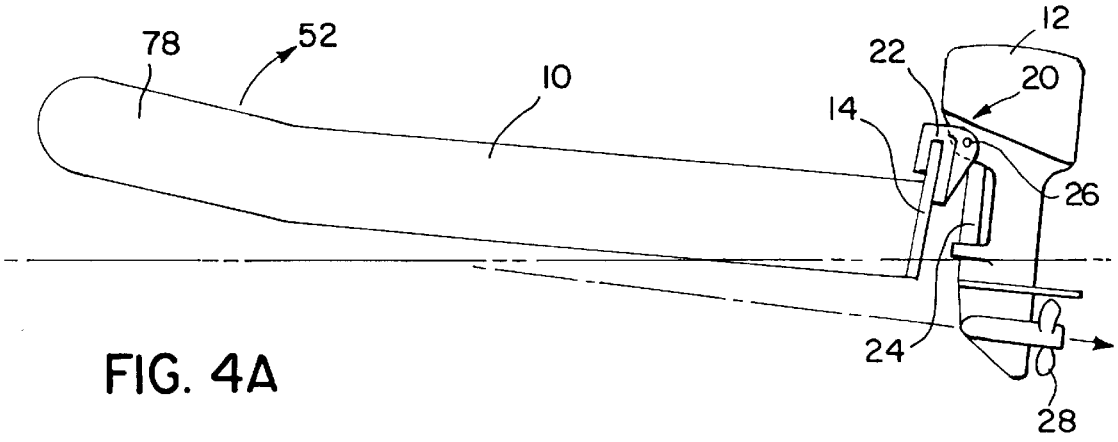
FIG. 4A is a schematic view showing a boat being accelerated by an outboard motor and lifting the bow of the boat out of the water.

FIG. 1 shows a rigid-hull inflatable boat 10 having an outboard motor 12 attached to the boat's transom 14. Rigid-hull inflatable boats, RIBs, are known in the prior art, for example as shown in U.S. Pat. No. 5,522,338, incorporated herein by reference. The boat 10 has a generally U-shaped inflatable tube 16 attached to a unitary rotationally molded hull 18. The hull 18 is preferably made of polyethylene, though other known rotational molding materials may be used. The outboard motor 12 drives a propeller 28. The outboard motor 12 is attached to the transom 14 by a tilt mechanism generally shown by arrow 20 including a transom bracket 22 and a swivel bracket 24. The transom bracket 22 has a pair of clamps 56, FIGS. 5–7, for attachment to the transom 14. The outboard motor pivots on the transom bracket about horizontal axis 26. The swivel bracket 24 is pivotally attached to the transom bracket 22 by a pivot tube 58, FIG. 9, for rotation about horizontal axis 26. The outboard motor 12 is rotatably mounted to the swivel bracket 24 about a vertical axis in a conventional manner for steering the boat 10. The tilt mechanism 20 enables positioning of the outboard motor 12 at a preselected trim angle.

Figure 6:
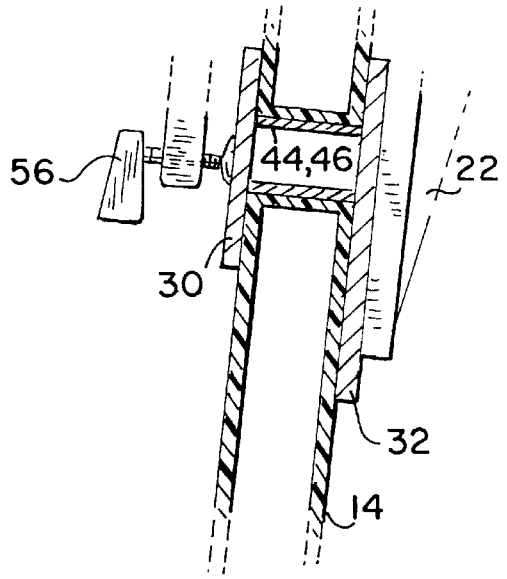
FIG. 6 is a detailed view showing a transom bracket attached to the transom of FIG. 5.

FIGS. 2 and 3 show a detailed exploded view of the transom 14. Before the outboard motor 12 is attached to the transom 14, a transom pad 32 and a transom plate 30 are attached to the transom to protect and strengthen the transom. In FIG. 2, the transom plate 30 is attached to the front side of the transom, while the transom pad 32 is attached to the aft side of the transom. Fasteners 36 and 38 extend through the transom 14 to secure the transom plate 30 and transom pad 32 to the transom. As an alternative, FIG. 3 shows a transom stiffener 34 placed over the top of the transom 14. The transom stiffener 34 is secured to the transom by fasteners 40 and 42 that extend through the transom. The transom 14 is further strengthened by anti-compression spacers 44 and 46 provided in respective holes 48 and 50 through the transom 14. The anti-compression spacers 44 and 46 prevent collapse of the transom 14 under transom bracket 22 clamping pressure. The outboard motor 12 is attached to the transom 14 by clamping the transom bracket 22 directly over the anti-compression spacers 44 and 46 as shown in FIG. 6.

Figure 4B:
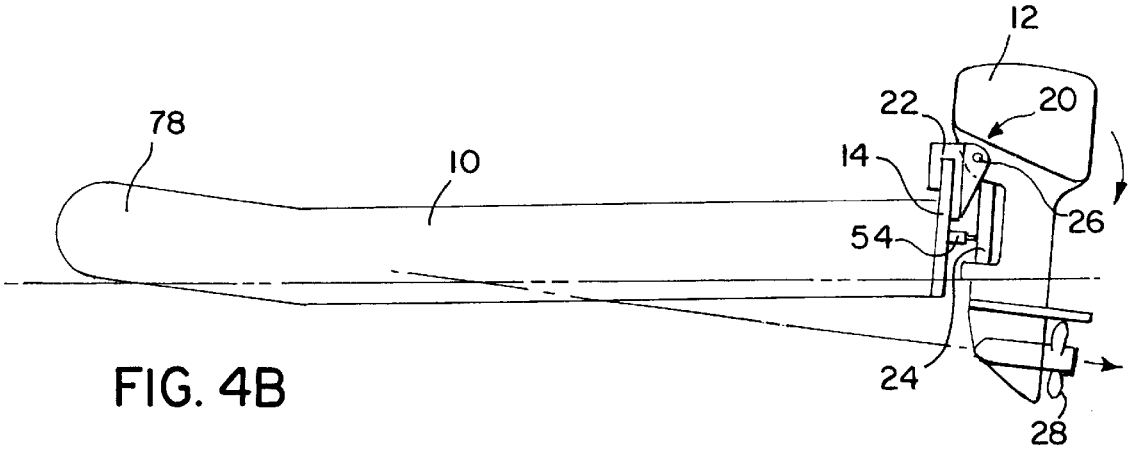
FIG. 4B is a schematic view showing the boat in FIG. 4A with an automatically adjustable trim system trimming the outboard motor propeller inwardly towards the boat to reduce bow lift.
Figure 4C:
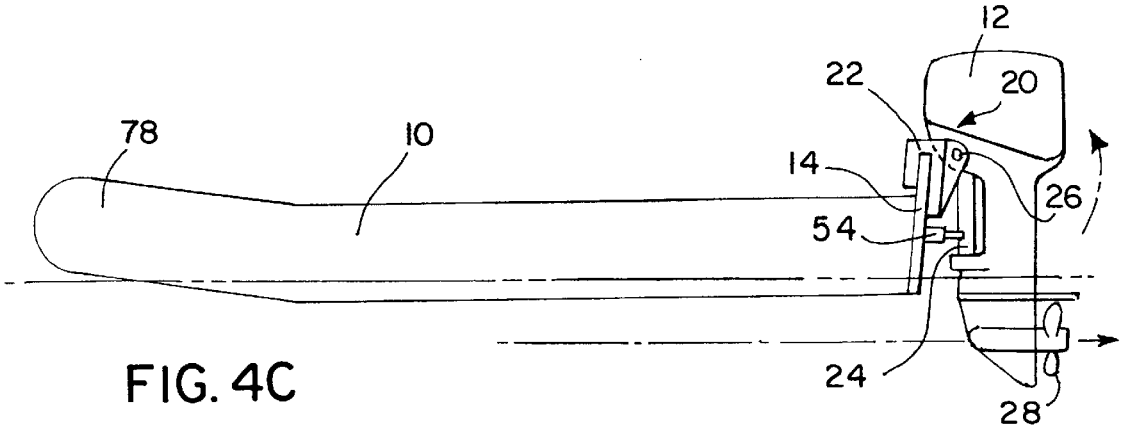
FIG. 4C is a schematic view showing the boat in FIG. 4B on plane with the outboard motor at a preselected trim angle.

Referring now to FIGS. 4A, 4B, and 4C, a rigid-hull inflatable boat 10 with an outboard motor 12 attached to the boat's transom 14 is shown. The outboard motor has a tilt mechanism 20 that includes a transom bracket 22 and a swivel bracket 24. The transom bracket 22 clamps to the transom 14, while the swivel bracket 24 pivotally attaches to the transom bracket 22 for rotation about horizontal axis 26. The tilt mechanism enables the outboard motor 12 to be set at a preselected trim angle. The outboard motor 12 drives a propeller 28 to propel the boat 10 through the water.

In FIG. 4A, the outboard motor 12 is accelerating the boat 10 through the water. Acceleration of the boat from a standstill or a relatively low speed increases the load on the propeller 28, causing a force to be exerted on the transom 14 by the transom bracket 22 which causes the bow 78 of the boat to lift up out of the water as shown by arrow 52, compromising acceleration and steering control of the boat.

In FIGS. 4B and 4C, operation of an automatically adjustable trim system 54 is shown. FIG. 4B shows the boat under acceleration like in FIG. 4A except that the automatically adjustable trim system provides automatic trimming-in of the propeller 28. The inward movement of the propeller 28 reduces bow lift, improving acceleration and steering control of the boat.

FIG. 4C shows the boat of FIG. 4B after it has gotten up on plane and has stopped accelerating. Once the boat 10 is up on plane and the acceleration loads on the propeller 28 decrease, the trim system 54 automatically returns the outboard motor 12 to its normal preselected trim angle.

Figure 5:
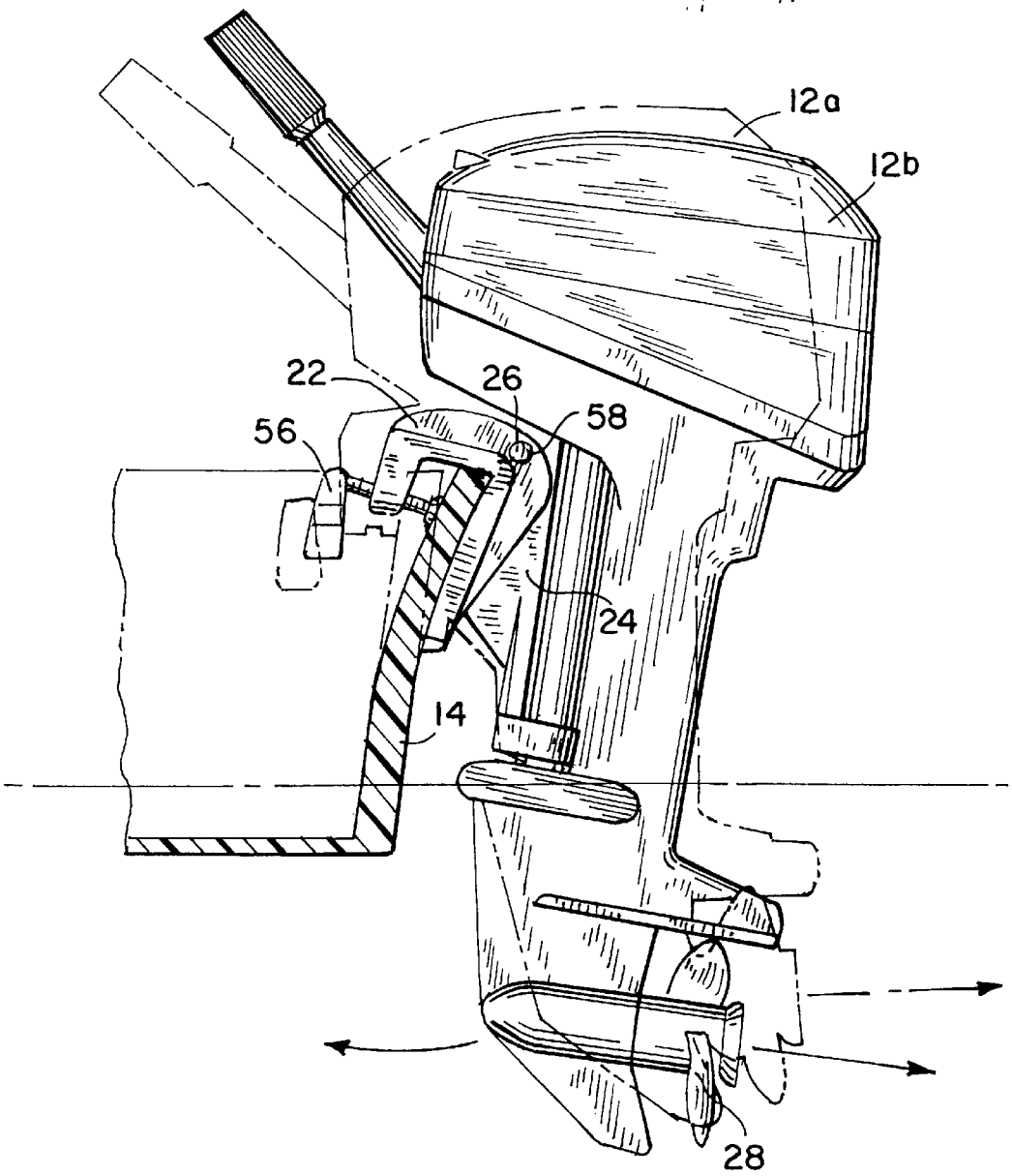
FIG. 5 is a side elevational view of an automatically adjustable trim system utilizing a flexible transom.

Referring now to FIG. 5, a first embodiment in accordance with the invention is shown. In this first embodiment, an automatically adjustable trim system for an outboard motor 12 is built into the boat's transom 14. The transom 14 is preferably manufactured from a material which has some give or flex in response to cantilever type forces exerted on it. Polyethylene is a plastic material which has been found to afford such give or flex in this type application in the structural dimensions of a transom. Transom bracket 22 has a pair of clamps 56 for attachment to the transom. A swivel bracket 24 is pivotally attached to the transom bracket by a pivot tube 58 for rotation about horizontal axis 26. The outboard motor 12 is mounted on the swivel bracket 24 in a conventional manner for tilting movement with the swivel bracket 24 about the horizontal axis 26 of the pivot tube 58.

Figure 7:
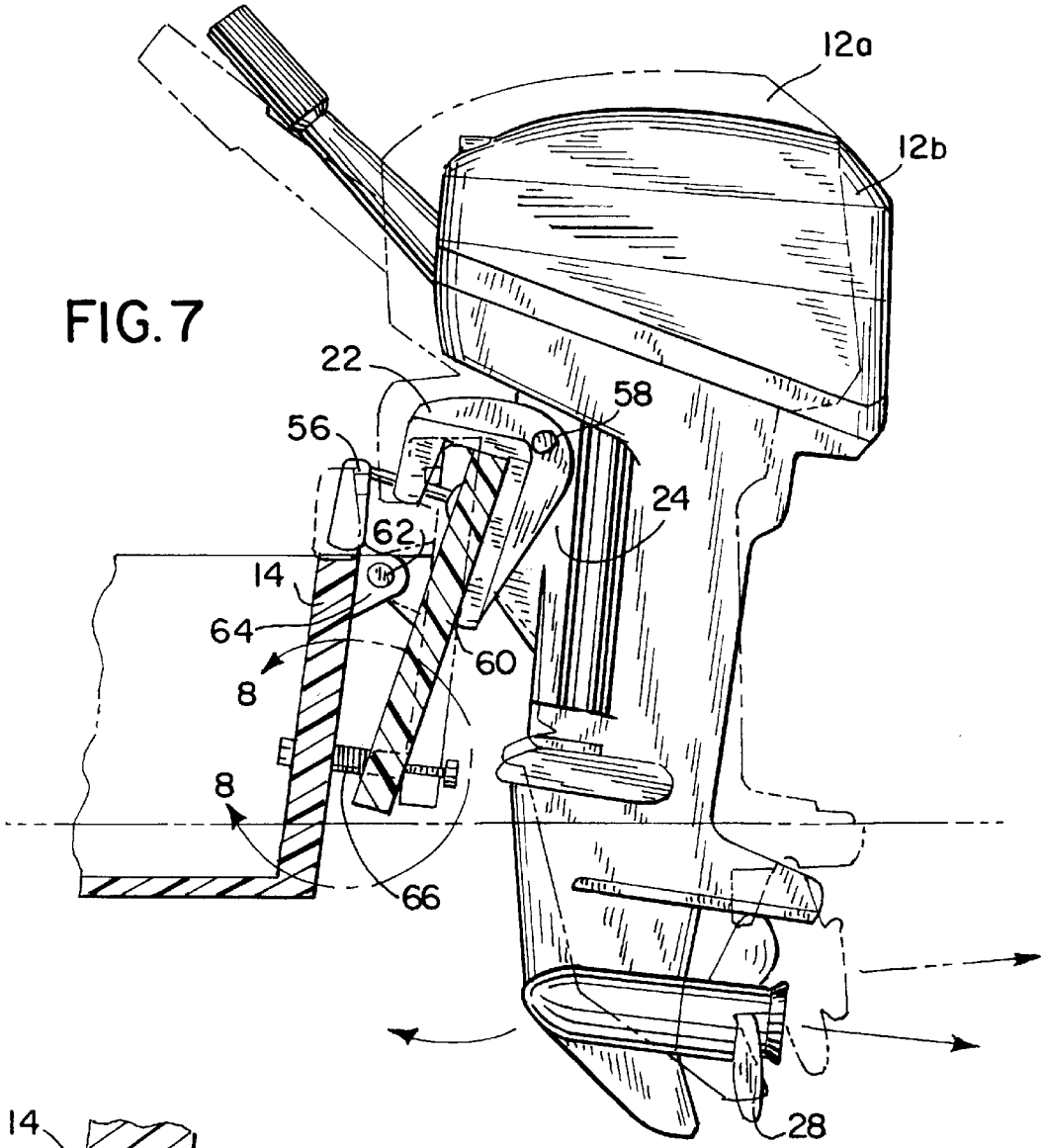
FIG. 7 is a side elevational view similar to FIG. 5 showing an automatically adjustable trim system utilizing a transom bracket mounting platform pivotally attached to the transom.
Figure 9:
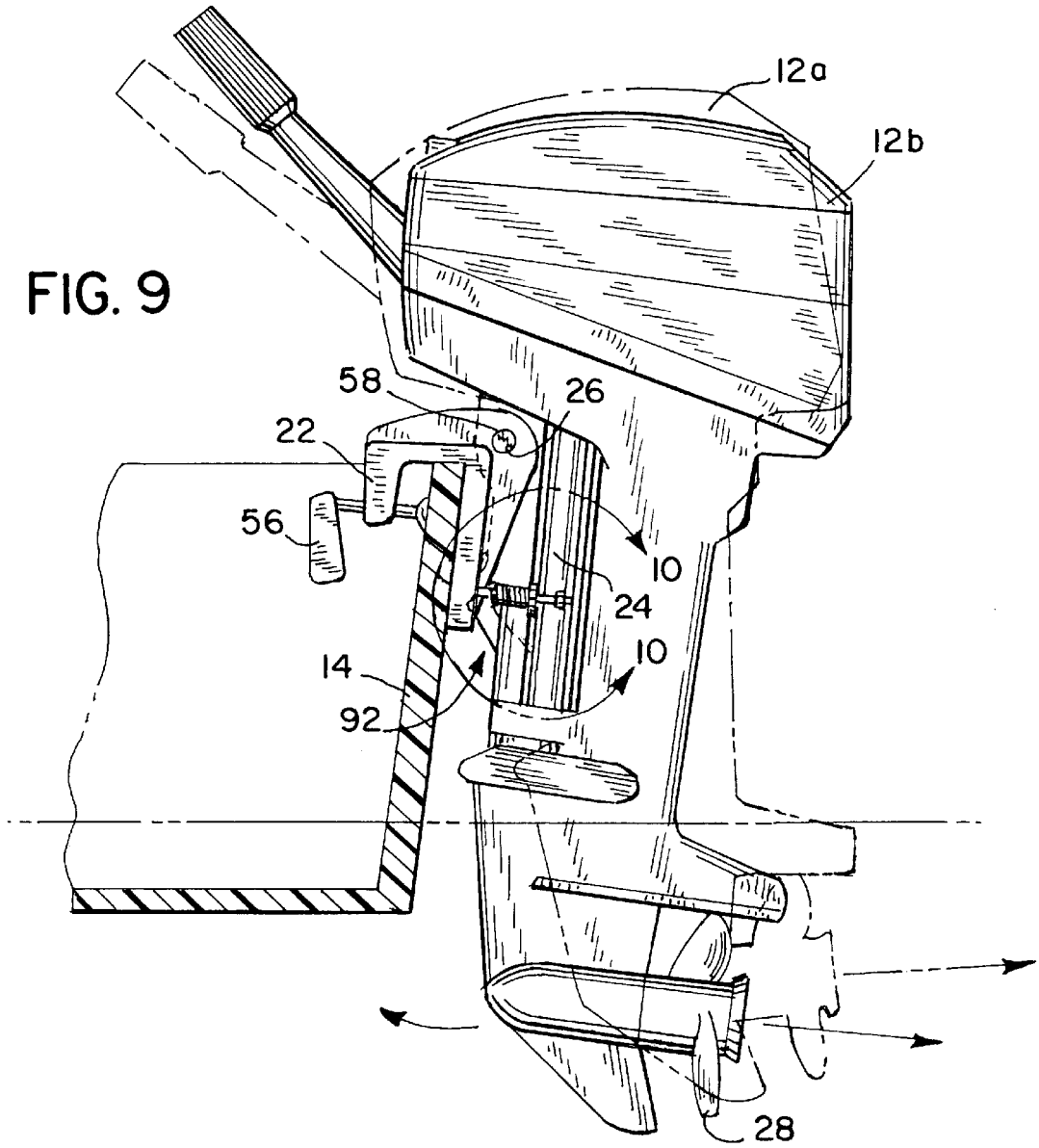
FIG. 9 is a side elevational view of an automatically adjustable trim system utilizing a trim angle biasing mechanism mounted between a swivel bracket and a transom bracket of an outboard motor.

FIGS. 5, 7 and 9 illustrate the outboard motor at a normal preselected trim angle position 12*a* in dashed line, and at a trimmed-in position 12*b* in solid line during acceleration of the boat. When the boat accelerates, increased loads on the propeller 28 cause the propeller to move inwardly towards the bottom of the boat, thereby exerting forces on the transom 14 through the transom bracket 22. These forces exerted on the transom 14 bend the flexible transom backwardly in response to acceleration loads on the propeller 28. Once the boat gets up on plane and stops accelerating, the loads on the propeller decrease, and in turn the forces exerted on the transom 14 decrease, allowing the flexible transom to return to its normal position, i.e., outboard motor 12 at position 12*a*. When the outboard motor 12 thrusts against the transom 14 during acceleration, the outboard motor moves to position 12*b*, and the propeller trims inwardly towards the bottom of the boat to trim the outboard motor appropriately during acceleration, reducing bow lift.

FIG. 6 shows a partial cross section of the hollow core transom 14. As described above, the outboard motor is clamped to the transom by clamps 56 of transom bracket 22. A transom pad 32 is provided on the aft side of the transom 14, and a transom plate 30 is provided on the front side of the transom to protect the transom from the transom bracket clamping pressure. The transom is hollow and has anti-compression spacers 44 and 46 provided in respective holes 48 and 50 through the transom to strengthen the transom. The anti-compression spacers prevent collapse of the transom under transom bracket clamping pressure.

Figure 8:
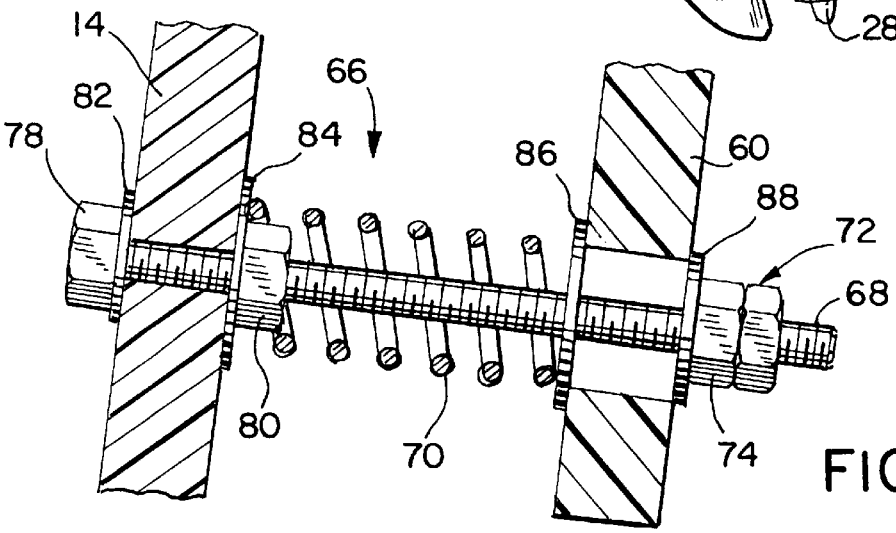
FIG. 8 is a detailed sectional view of the region within arc 8—8 of FIG. 7 showing a trim angle biasing mechanism.

Referring now to FIGS. 7 and 8, a second embodiment of the present invention is shown. An automatically adjustable trim system includes a transom bracket mounting platform 60 that is generally parallel to and pivotally attached to a rigid transom 14 by a pivot tube bracket assembly 64 for rotation about horizontal axis 62. A trim angle biasing mechanism 66 is mounted between the transom 14 and the platform 60 below the pivot tube bracket assembly 64. The trim angle biasing mechanism 60 maintains the position of the outboard motor 12 at a preselected trim angle, unless increased loads on the propeller 28 cause the transom bracket 22 to exert forces on the platform 60 rotating the platform 60 inwardly towards the transom 14 about horizontal axis 62 against the biasing force of the trim angle biasing mechanism 66. The platform 60 is preferably rigid, but can also be flexible for the reasons noted above. The flexible platform 60 would be preferably made from polyethylene or some other material having the noted give or flex.

The trim angle biasing mechanism 66 is shown in detail in FIG. 8. The biasing mechanism 66 includes a connecting rod 68 mounted generally perpendicularly between the transom 14 and the platform 60. The connecting rod 68 extends through the transom 14 and through the platform 60. A compression spring 70 is mounted over the connecting rod 68 between the transom 14 and the platform 60. In particular, the connecting rod 68 is slidably mounted through the platform 60 to allow the platform 60 to move inwardly towards the transom 14 in response to forces exerted on the platform 60 by the transom bracket 22. The connecting rod 68 is preferably a threaded screw or bolt having a head 78 at one end. The connecting rod 68 also includes an adjustment member provided by threaded nut 80 integral with washer 84 between the transom 14 and the platform 60 to adjust the compression of compression spring 70. At the opposite end of the connecting rod 68 from the head 78 is a trim angle limit stop 72 which prevents movement of the transom bracket mounting platform 60 outwardly beyond a maximum trim angle position. The trim angle limit stop 72 includes at least one threaded nut 74 mounted on the end of the connecting rod 68. The trim angle biasing mechanism 66 also includes washers 82, 84, 86, and 88 mounted on the connecting rod 68 on both sides of transom 14 and transom bracket mounting platform 60. As an alternative to the above described trim angle biasing mechanism, a torsion bar can be mounted in the pivot tube bracket assembly 64 at pivot point 62.

Figure 10:
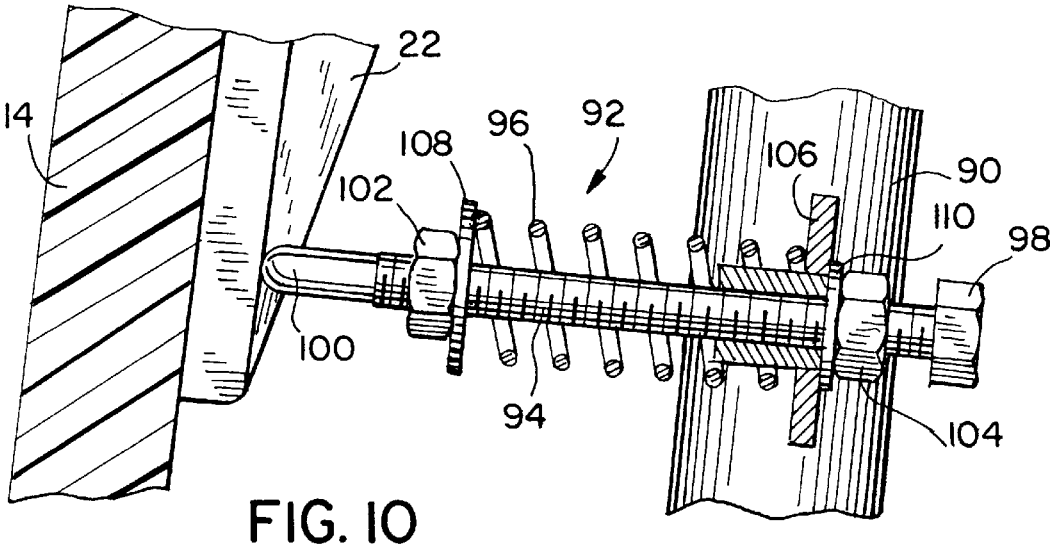
FIG. 10 is a detailed sectional view of the region within arc 10—10 in FIG. 9 showing a trim angle biasing mechanism.

Referring now to FIGS. 9 and 10, a third embodiment of the invention is shown. In this embodiment, a trim angle biasing mechanism 92 is attached to the swivel bracket 24 of the outboard motor 12 between a swivel tube 90 and the transom bracket 22. An outboard motor 12 is attached to a rigid transom 14.

FIG. 10 shows the trim angle biasing mechanism 92 including a connecting rod 94 mounted generally perpendicularly between the swivel tube 90 and the transom bracket 22. The connecting rod 94 extends through the swivel tube 90 at section 106 and touches the back side of the transom bracket 22. The connecting rod 94 is preferably a threaded screw or bolt having a head 98 at one end and having a smooth rounded point 100 at the opposite end. Adjustment nut 102 and washer 108 adjust compression of spring 96. Nut 104 and washer 110 adjust spacing of swivel tube 90 from transom bracket 22.

Figure 11:
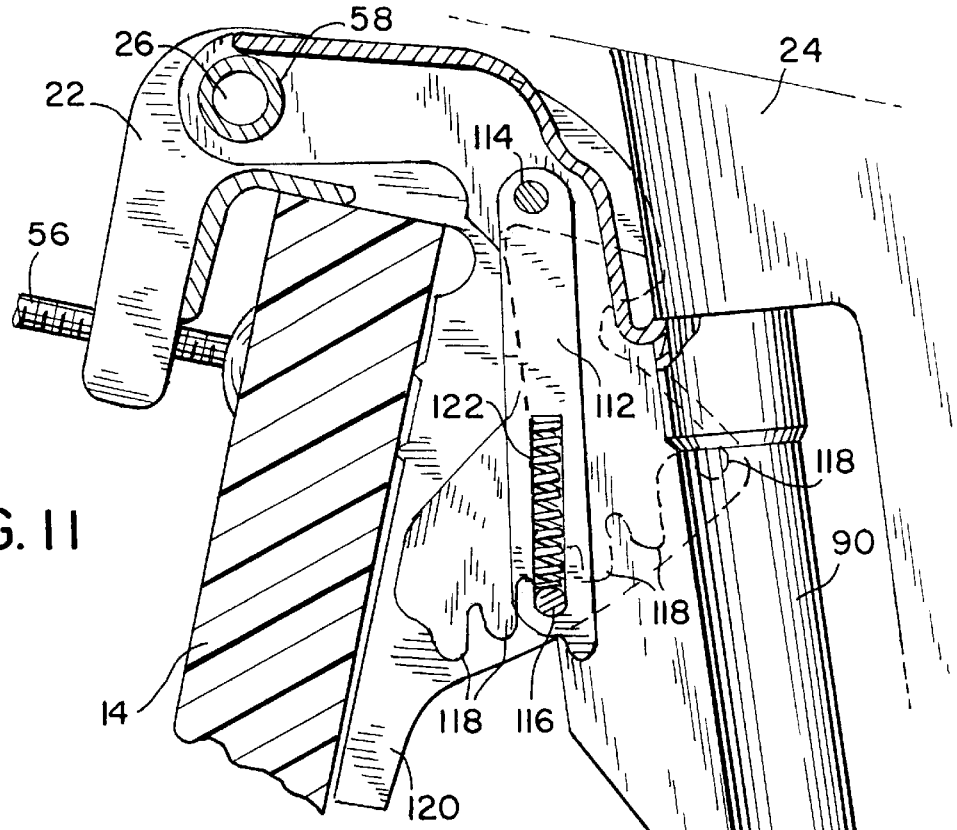
FIG. 11 is a side elevational view of a transom bracket having a trim angle biasing mechanism installed therein with an outboard motor in a normal preselected trim position.
Figure 12:
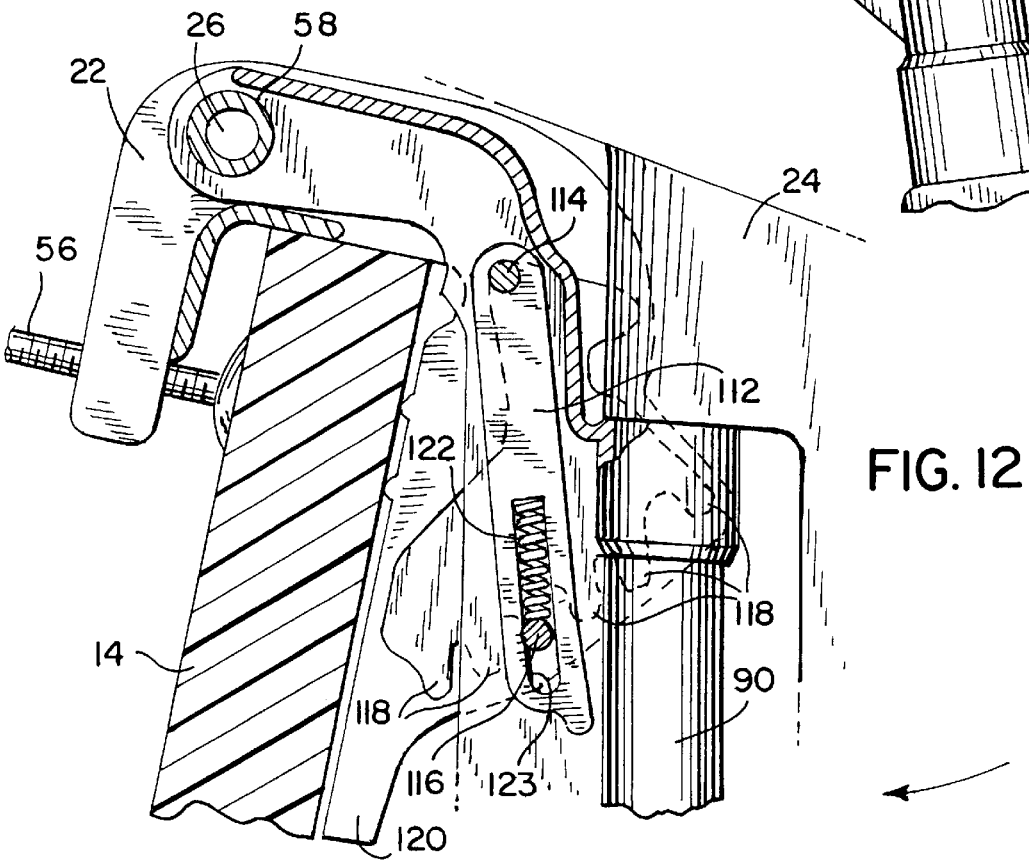
FIG. 12 is a side elevational view similar to FIG. 11 showing the trim angle biasing mechanism in a trimmed-in position.

FIGS. 11 and 12 show a fourth embodiment of the present invention, including in combination with a tilt mechanism. Tilt mechanisms are known in the prior art, for example as shown in U.S. Pat. No. 4,925,410, incorporated herein by reference. In FIGS. 11 and 12, a spring-loaded pawl assembly 112 has one end pivotally attached to the swivel bracket 24 about horizontal axis 114, and has another end including a trim pin 116 adapted to engage one or more trim position notches 118 in the transom bracket 22 for adjusting the preselected trim angle of the outboard motor.

In general, the transom bracket 22 has a closed circuit cam track 120 that includes a plurality of position notches 118 circumferentially spaced about horizontal axis 26 of pivot tube 58. The pawl assembly 112 is pivotally attached at one end to swivel bracket 24 to rotate about horizontal axis 114. A trim pin 116 is attached to the other end of the pawl assembly 112. A compression spring 122 located within a slotted groove 123 biases the trim pin 116 to engage the cam track notches 118 to provide a series of trim positions, and to allow movement of the outboard motor propeller inwardly towards the boat to adjust the trim angle in response to increased loads on the propeller. Compression spring 122 extends along a radius from horizontal axis 114. FIG. 11 shows the automatically adjustable trim system at a normal preselected trim angle, and FIG. 12 shows a trimmed-in position during acceleration. The spring-loaded pawl assembly 112 of FIG. 12 provides automatic trimming-in of the propeller during acceleration, to reduce bow lift. The trim pin 116 can be manually shifted between the trim position notches 118 to adjust the tilt of the outboard motor.

The various embodiments of the automatically adjustable trim system described above include a trim angle biasing mechanism having a spring biasing force that increases from a minimum displacement value to a maximum displacement value to maintain the marine propulsion system at a preselected trim angle when the propeller loads on the propulsion system are less than the spring biasing force minimum displacement value. However, the automatically adjustable trim system allows the propulsion system to trim inwardly against the spring biasing force when the propeller loads on the propulsion system are greater than the spring biasing force minimum displacement value. Once the propeller loads on the propulsion system are less than the spring biasing force minimum displacement value, the propulsion system returns to its normal preselected trim angle.

While the invention has been described with reference to preferred embodiments, those skilled in the art will appreciate that certain substitutions, alterations and omissions may be made without departing from the spirit of the invention. For example, the various embodiments of the automatically adjustable trim system described above may be incorporated in an inboard/outboard (stern drive) marine propulsion system. The typical inboard/outboard marine propulsion system has an engine located within a boat and an outdrive powered by the engine. The outdrive is mounted to the boat's transom and has a propeller attached thereto. A trim angle biasing mechanism may be incorporated in the outdrive to provide means for positioning the outdrive at a preselected trim angle, and means for automatically trimming the outdrive inwardly towards the boat to adjust the trim angle in response to increased loads on the propeller. Accordingly, the foregoing description is meant to be exemplary only, and should not be deemed limitative of the scope of the invention set forth in the following claims.

I claim:

1. In a marine propulsion system having a propulsion unit with a propeller for propelling a boat, an automatically adjustable trim system supporting the propulsion unit from the transom of the boat, comprising:

a transom bracket mounting platform pivotally attached to the transom for rotation about a horizontal axis;

a tilt mechanism comprising a transom bracket mounted to the transom bracket mounting platform, and a swivel bracket pivotally attached to the transom bracket for tilting the propulsion unit to a preselected trim angle, the propulsion unit being pivotally attached to the swivel bracket for steering the boat; and a trim angle biasing mechanism mounted between the transom and the transom bracket mounting platform to maintain the propeller at the preselected trim angle unless increased loads on the propeller cause the transom bracket to exert forces on the transom bracket mounting platform rotating the transom bracket mounting platform against the biasing force of the trim angle biasing mechanism.

2. The automatically adjustable trim system as recited in claim 3 wherein the trim angle biasing mechanism comprises a connecting rod extending between the transom and the transom bracket mounting platform, the transom bracket mounting platform being movable along the connecting rod, the direction of movement of said transom bracket mounting platform being perpendicular to the transom.

3. The automatically adjustable trim system as recited in claim 4 comprising a compression spring mounted over the connecting rod between the transom and the transom bracket mounting platform.

4. The automatically adjustable trim system as recited in claim 4 wherein the connecting rod includes at least one trim angle limit stop which prevents movement of the transom bracket mounting platform outwardly beyond a maximum trim angle position.

5. The automatically adjustable trim system as recited in claim 3 wherein the biasing force of the trim angle biasing mechanism is adjustable.

6. The automatically adjustable trim system as recited in claim 3 wherein the trim angle biasing mechanism includes:

a connecting rod mounted to the transom and slidably mounted through the transom bracket mounting platform, the connecting rod including an adjustment member between the transom and the transom bracket mounting platform; and a compression spring mounted over the connecting rod between the adjustment member and the transom bracket mounting platform, wherein the distance of the adjustment member from the transom bracket mounting platform is adjustable.

7. The automatically adjustable trim system as recited in claim 3 wherein the trim angle biasing mechanism includes:

a connecting rod extending between the transom and the transom bracket mounting platform, the connecting rod including an adjustment member between the transom bracket mounting platform and the transom; and a compression spring mounted over the connecting rod, wherein the distance of the adjustment member from the transom is adjustable.

8. The automatically adjustable trim system as recited in claim 3 wherein the transom is rigid.

9. In a marine propulsion system having a propulsion unit with a propeller for propelling a boat, an automatically adjustable trim system supporting the propulsion unit from the transom of the boat, comprising:

a transom bracket mounting platform pivotally attached to the transom for rotation about a horizontal axis;

a tilt mechanism comprising a transom bracket mounted to the transom bracket mounting platform, and a swivel bracket pivotally attached to the transom bracket for tilting the propulsion unit to a preselected trim angle, the propulsion unit being pivotally attached to the swivel bracket for steering the boat; and a trim angle biasing mechanism mounted between the transom and the transom bracket mounting platform to maintain the propeller at the preselected trim angle unless increased loads on the propeller cause the transom bracket to exert forces on the transom bracket mounting platform rotating the transom bracket mounting platform against the biasing force of the trim angle biasing mechanism, wherein the trim angle biasing mechanism comprises:

a connecting rod extending between the transom and the transom bracket mounting platform, the transom bracket mounting platform being movable along the connecting rod relative to the transom; and a compression spring mounted over the connecting rod between the transom and the transom bracket mounting platform.

10. The automatically adjustable trim system as recited in claim 9 wherein the connecting rod includes at least one trim angle limit stop which prevents movement of the transom bracket mounting platform outwardly beyond a maximum trim angle position.

* * * * *

UNITED STATES PATENT AND TRADEMARK OFFICE

CERTIFICATE OF CORRECTION

PATENT NO. : 6,007,391

DATED : December 28, 1999

INVENTOR(S) : John R Eilert

It is certified that error appears in the above-identified patent and that said Letters Patent is hereby corrected as shown below:

CLAIM 2, column 7, line 57, change "3" to -- 1 --

CLAIM 3, column 7, line 64,change "4" to -- 2 --

2); CLAIM 4, column 8, line 2, change "4" to -- 2 --

CLAIM 5, column 8, line 7, change "3" to -- 1 --

CLAIM 6, column 8, line 10, change "3" to -- 1 --

CLAIM 7, column 8, line 22, change "3" to -- 1 --

CLAIM 8, column 8, line 31, change "3" to -- 1 --

Signed and Sealed this

Sixteenth Day of January, 2001

*Attest:*

*Attesting Officer*

Q. TODD DICKINSON

*Commissioner of Patents and Trademarks*